US010697450B2

(12) United States Patent
Tanaka et al.

(10) Patent No.: US 10,697,450 B2
(45) Date of Patent: Jun. 30, 2020

(54) PUMP HAVING A TOP PORTION FIXED TO AN EXTERNAL STRUCTURE

(71) Applicant: Murata Manufacturing Co., Ltd., Kyoto (JP)

(72) Inventors: Nobuhira Tanaka, Kyoto (JP); Daisuke Kondo, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 15/800,683

(22) Filed: Nov. 1, 2017

(65) Prior Publication Data

US 2018/0051686 A1 Feb. 22, 2018

Related U.S. Application Data

(63) Continuation of application No. PCT/JP2016/063136, filed on Apr. 27, 2016.

(30) Foreign Application Priority Data

May 8, 2015 (JP) ..... 2015-095446

(51) Int. Cl.
*F04B 43/04* (2006.01)
*F04B 45/047* (2006.01)
(Continued)

(52) U.S. Cl.
CPC ..... *F04B 43/046* (2013.01); *F04B 9/02* (2013.01); *F04B 19/22* (2013.01); *F04B 35/045* (2013.01);
(Continued)

(58) Field of Classification Search
CPC ..... F04B 53/102; F04B 53/1082; F04B 45/0536; F04B 43/095; F04B 17/003;
(Continued)

(56) References Cited

U.S. PATENT DOCUMENTS 4,864,918 A * 9/1989 Martin ..... F04B 43/0054 92/103 SD
5,145,336 A * 9/1992 Becker ..... F04B 43/0054 417/413.1
2009/0010780 A1* 1/2009 Kamitani ..... F04B 43/046 417/413.2
2009/0148320 A1* 6/2009 Lucas ..... F04B 43/046 417/481
(Continued)

FOREIGN PATENT DOCUMENTS

JP 2009250132 A 10/2009
JP 2012107636 A 6/2012
(Continued)

OTHER PUBLICATIONS

International Search report issued in PCT/JP2016/063136 dated Aug. 2, 2016.
(Continued)

*Primary Examiner* — Bryan M Lettman
*Assistant Examiner* — Timothy P Solak
(74) *Attorney, Agent, or Firm* — Pearne & Gordon LLP

(57) ABSTRACT

A fluid control device includes a pump and an external structure. The pump includes an actuator, a top portion opposed to the actuator such that a gap is disposed therebetween in the thickness direction, and a side wall plate extending from the top portion in the thickness direction and supporting a vibration member. The actuator includes the plate-like vibration member and a piezoelectric element configured to cause the vibration member to vibrate in the thickness direction. The top portion includes a projection portion and a fixation portion projecting beyond the side wall plate in an outward direction perpendicular to the thickness direction. The top portion is fixed to an external structure outside the projection portion.

19 Claims, 16 Drawing Sheets

(51) Int. Cl.

| | |
|---|---|
| ***F04B 53/10*** | (2006.01) |
| ***F04B 35/04*** | (2006.01) |
| ***F04B 19/22*** | (2006.01) |
| ***F04B 9/02*** | (2006.01) |
| ***F04B 43/00*** | (2006.01) |
| ***F04B 43/02*** | (2006.01) |
| ***F04B 39/12*** | (2006.01) |
| ***F04B 17/00*** | (2006.01) |
| ***F04B 43/09*** | (2006.01) |

(52) U.S. Cl.
CPC ..... *F04B 39/121* (2013.01); *F04B 43/0009* (2013.01); *F04B 43/02* (2013.01); *F04B 43/04* (2013.01); *F04B 45/047* (2013.01); *F04B 53/102* (2013.01); *F04B 17/003* (2013.01); *F04B 43/095* (2013.01); *F04B 2203/0404* (2013.01)

(58) Field of Classification Search
CPC .. F04B 17/044; F04B 39/1066; F04B 45/027; F04B 2203/0404; F04B 43/0009
See application file for complete search history.

(56) References Cited

U.S. PATENT DOCUMENTS

| | | | | |
|---|---|---|---|---|
| 2013/0071269 | A1* | 3/2013 | Fujisaki | F04B 43/046 417/413.2 |
| 2013/0255801 | A1 | 10/2013 | Hirata et al. | |
| 2014/0028153 | A1* | 1/2014 | Smirnov | F04B 43/046 310/328 |
| 2014/0044568 | A1 | 2/2014 | Fouillet et al. | |

FOREIGN PATENT DOCUMENTS

| | | | |
|---|---|---|---|
| JP | 2013169374 | A | 9/2013 |
| JP | 2014066364 | A | 4/2014 |
| JP | 5692468 | B2 | 4/2015 |
| WO | 2014024608 | A1 | 2/2014 |

OTHER PUBLICATIONS

Written Opinion issued in PCT/JP2016/063136 dated Aug. 2, 2016.
Chinese Office Action for Application No. 201680025549.3 dated Aug. 29, 2018.

* cited by examiner

-- Prior Art --

PUMP HAVING A TOP PORTION FIXED TO AN EXTERNAL STRUCTURE

This application is a continuation of International Application No. PCT/JP2016/063136 filed on Apr. 27, 2016 which claims priority from Japanese Patent Application No. 2015-095446 filed on May 8, 2015. The contents of these applications are incorporated herein by reference in their entireties.

BACKGROUND

Technical Field

The present disclosure relates to a pump for sucking and discharging fluid and a fluid control device for controlling a fluid flow.

FIG. 22 is a side cross-sectional view that illustrates a configuration of a known pump 901 (see, for example, Patent Documents 1 to 3). As illustrated in FIG. 22, the known pump 901 includes a top portion 902, a side wall portion 903, and a vibration portion 904. The top portion 902, side wall portion 903, and vibration portion 904 form a box shape having a vibration space 910 inside the box shape. The vibration portion 904 is opposed to the top portion 902 such that the vibration space 910 is disposed therebetween. The side wall portion 903 has the same external shape as that of the top portion 902, projects from the top portion 902 so as to cover the surrounding area of the vibration space 910, and elastically supports the circumferential portion in the vibration portion 904. A fixation ring (sealing) 911 is attached to the top surface side of the top portion 902 in the pump 901, and the pump 901 is fixed to an external structure 912 with the fixation ring (sealing) 911 interposed therebetween.

When the pump 901 is driven, the vibration portion 904 vibrates in the thickness direction. The vibration is transmitted to the top portion 902 through the side wall portion 903. This causes the top portion 902 to vibrate in the thickness direction, in addition to the vibration portion 904, and produces a fluid flow in the vibration space 910, which is present between the vibration portion 904 and the top portion 902.

Patent Document 1: Japanese Unexamined Patent Application Publication No. 2014-066364

Patent Document 2: Japanese Unexamined Patent Application Publication No. 2013-169374

Patent Document 3: Japanese Unexamined Patent Application Publication No. 2012-107636

BRIEF SUMMARY

Because the pump having the above-described configuration is used in the state where the top portion is fixed to the external structure, leakage of the vibration from the top portion to the external structure may significantly attenuate vibrations of the vibration plate and top portion. This may reduce the quantity of flow or the pressure of fluid sucked and discharged by the pump. An experiment conducted by the inventors reveals that changes in the gap in the thickness direction occurring in the vibration space decreases by approximately 47% on average in the case where the top portion is fixed to the external structure, in comparison with that in the case where it is not fixed.

Accordingly, the present disclosure provides a pump and a fluid control device capable of suppressing leakage of vibration when a top portion is fixed to an external structure and capable of efficiently controlling fluid.

A pump and a fluid control device according to the present disclosure have a configuration described below to solve the above-described problem.

The pump according to the present disclosure includes an actuator, a top portion, and a side wall portion. The actuator is configured to vibrate in a thickness direction. The side wall portion supports an end portion of the actuator. The top portion is supported by the side wall portion, and the top portion defines a space with the actuator and the side wall portion. The top portion includes a top surface portion, a joint portion, a projection portion, and a fixation portion.

The top surface portion is opposed to the actuator such that a gap is disposed therebetween in the thickness direction. The joint portion extends from the top surface portion in an outward direction perpendicular to the thickness direction, and the joint portion is joined to the side wall portion. The projection portion extends from the joint portion in the outward direction and projects beyond the side wall portion. The fixation portion extends from the projection portion in the outward direction, and the fixation portion is fixed to an external structure.

In this configuration, vibration caused by the actuator being driven is transmitted to the top portion through the side wall portion, and the top portion vibrates with the actuator. The top portion is fixed to the external structure with the fixation portion outside the projection portion, which projects beyond the side wall portion in the outward direction. Thus, leakage of the vibration in the top portion in the pump having this configuration is smaller than that in the case where the pump is fixed to the external structure in a position opposed to the side wall portion. Accordingly, the pump having this configuration can prevent a reduction in the changes in the gap in the space disposed between the top portion and actuator (hereinafter referred to as vibration space) and can efficiently control the fluid flow in the vibration space. The pump having this configuration can achieve high pump efficiency.

In the above-described pump, the projection portion may include a first thin portion thinner than the joint portion. That is, the dimension of the top portion in the thickness direction may be locally small in the projection portion. The first thin portion may be arranged in, for example, a ring shape. Thus, the pump having this configuration can reduce the stiffness of the projection portion and can further suppress the leakage of the vibration through the projection portion.

The projection portion may include a second thin portion thinner than the joint portion. A distance from a central axis of the top surface portion to the first thin portion may differ from a distance from the central axis of the top surface portion to the second thin portion. The projection portion may have no opening. In the above-described pump, when d denotes a dimension of the projection portion in the outward direction and t denotes a dimension of the projection portion in the thickness direction, a following conditional expression, $$d \geq 0.05 \cdot t^{(2/3)} \quad \text{[Math. 1]}$$

may be satisfied.

In particular, a following conditional expression $$d \geq 0.06 \cdot t^{(2/3)} \quad \text{[Math. 2]}$$

may further be satisfied.

In the above-described configuration, when the top portion is fixed to the external structure, the fluid can be controlled with efficiency compared favorably with that when the top portion is not fixed to the external structure. Specifically, the inventors found that, in the case of [Math. 1], in the state where the top portion is fixed to the external structure, in comparison with the state where the top portion is not fixed to the external structure, the changes in the gap occurring in the vibration space in the thickness direction exceeded approximately 90%. The inventors found that, in the case of [Math. 2], the changes in the gap occurring in the vibration space in the thickness direction exceeded approximately 99%.

Additionally, a following conditional expression $$0.06 \cdot t^{(2/3)} \leq d \leq 0.066 \cdot t^{(2/3)} \quad \text{[Math. 3]}$$

may further be satisfied. This configuration can control the fluid with sufficient efficiency and can prevent an excessive increase in the dimension of the pump in the outward direction.

The fluid control device according to the present disclosure includes the above-described pump and the external structure. Because the fluid control device having this configuration includes the above-described pump, it can achieve high pump efficiency.

In the above-described fluid control device, the top surface portion may have a plurality of channel holes communicating with the space, and the external structure may be a valve housing including a valve for opening or closing the plurality of channel holes. The fluid control device having this configuration can prevent backflow of the fluid into the vibration space by using the valve.

According to the present disclosure, the leakage of vibration when the top portion is fixed to the external structure can be suppressed, the fluid can be efficiently controlled in the fluid control device, and high pump efficiency can be achieved in the pump.

DETAILED DESCRIPTION

A plurality of embodiments according to the present disclosure are described below. A fluid control device according to the present disclosure can be configured to control a flow of gas or any other fluid, such as liquid, gas-liquid mixed fluid, solid-gas mixed fluid, solid-liquid mixed fluid, gel, and gel-mixed fluid.

First Embodiment

Figure 5:
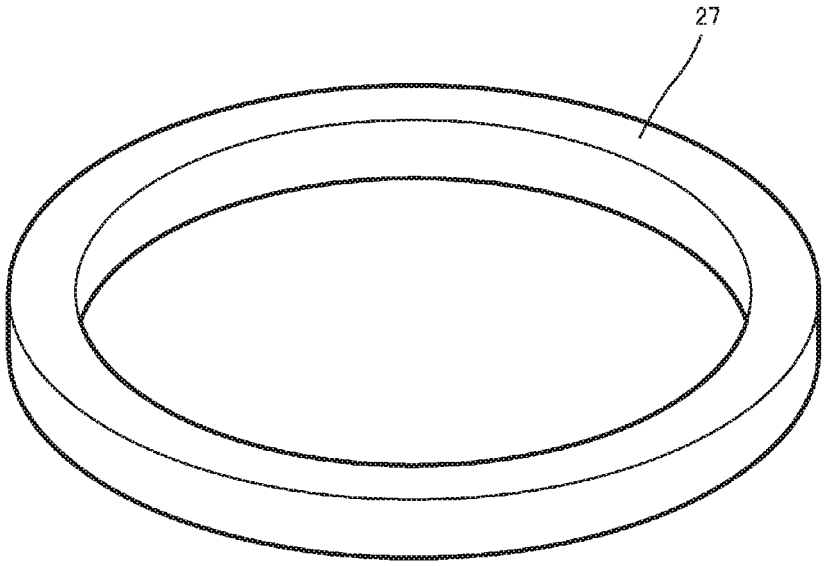
FIG. 5 is an external perspective view of an external structure 27 illustrated in FIG. 4.

A fluid control device 10 according to a first embodiment of the present disclosure is described below. The fluid control device 10 in the first embodiment includes a pump 50 and an external structure 27, as illustrated in FIG. 5 described below. The fluid control device 10 is a suction device for sucking fluid or a discharge device for discharging fluid. The fluid control device 10 may constitute, for example, a sphygmomanometer including a cuff, a milking machine, or a nasal aspirator.

Figure 1:
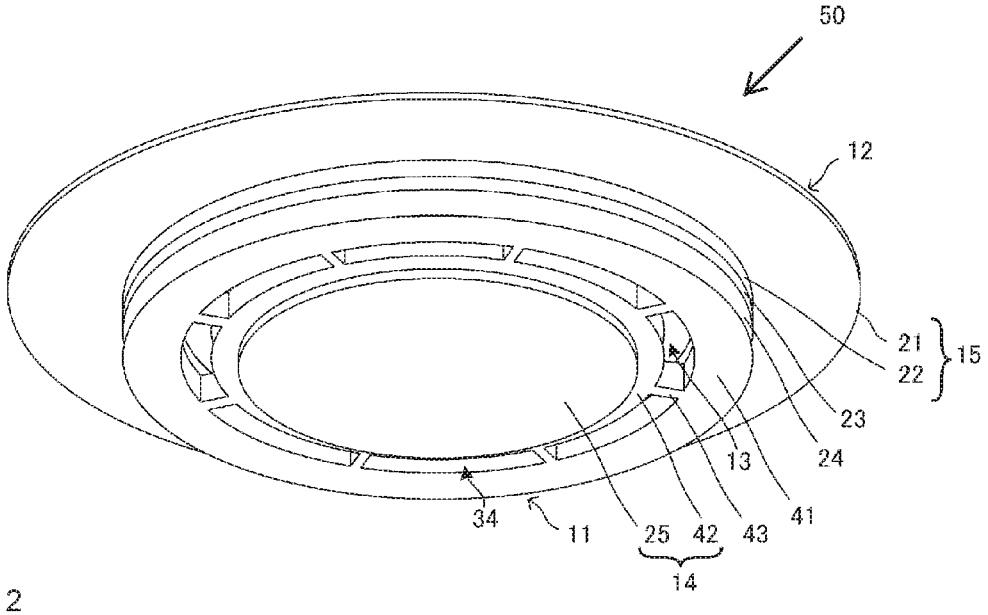
FIG. 1 is an external perspective view of a pump 50 according to a first embodiment of the present disclosure as seen from a bottom surface side.
Figure 2:
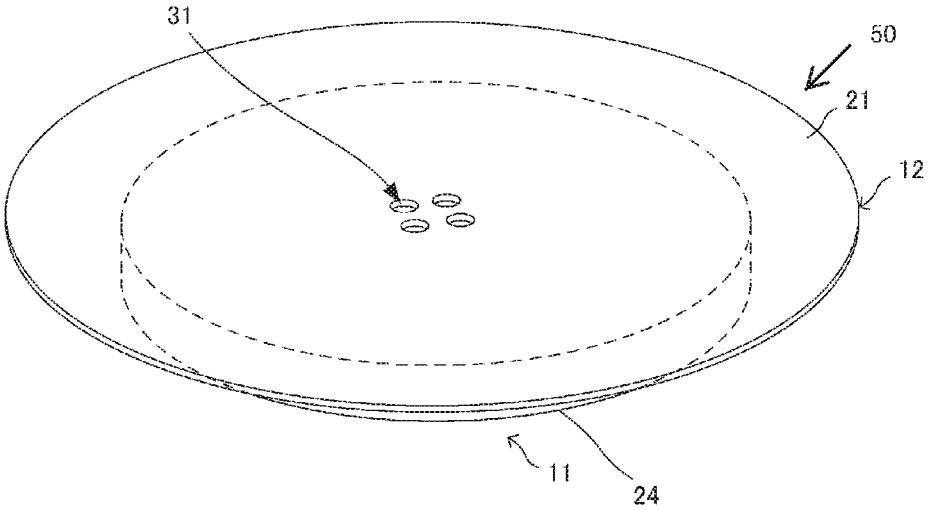
FIG. 2 is an external perspective view of the pump 50 illustrated in FIG. 1 as seen from a top surface side.
Figure 3:
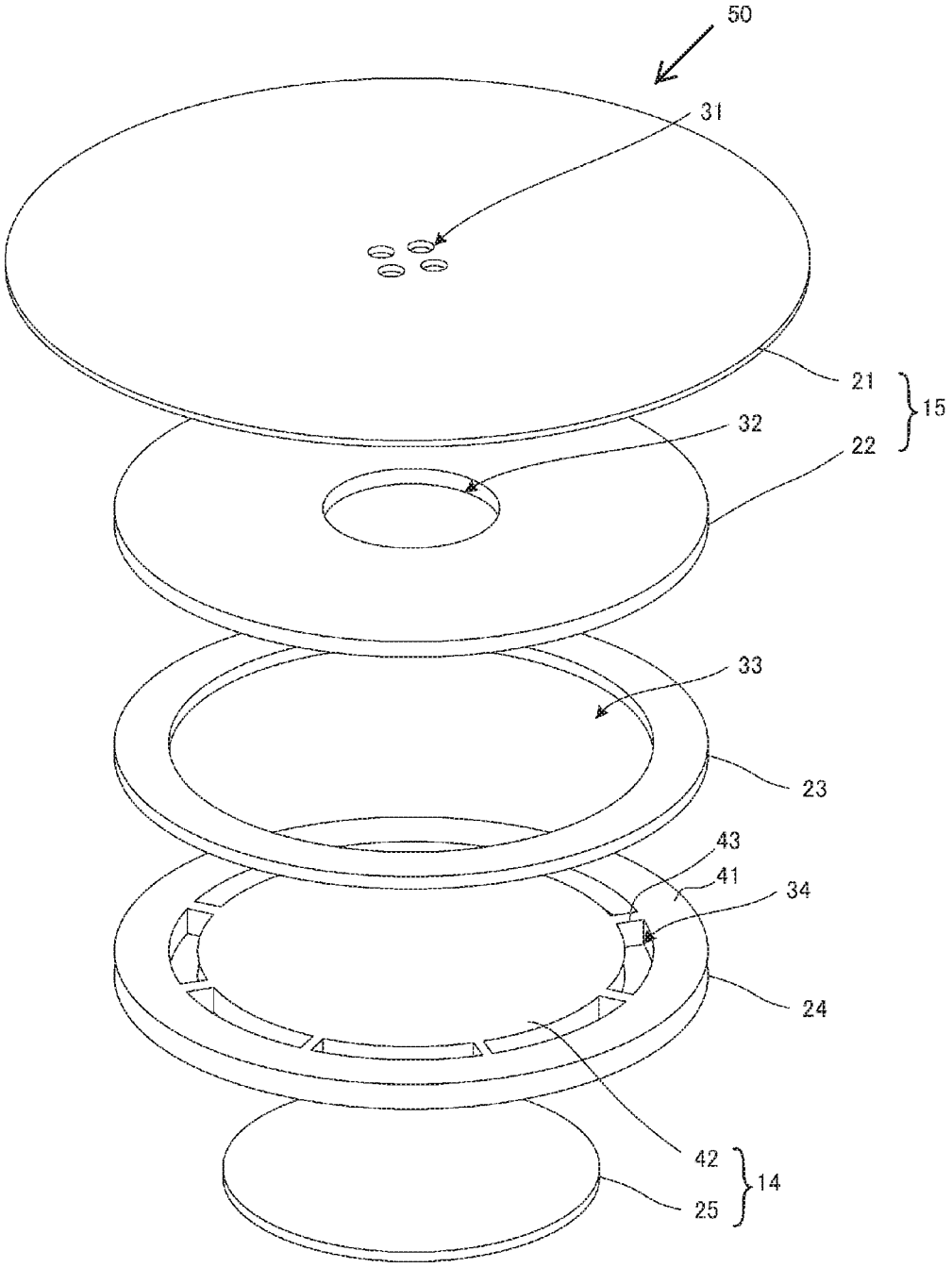
FIG. 3 is an exploded perspective view of the pump 50 illustrated in FIG. 1.

FIG. 1 is an external perspective view of the pump 50 according to the first embodiment of the present disclosure as seen from a bottom surface side. FIG. 2 is an external perspective view of the pump 50 illustrated in FIG. 1 as seen from a top surface side. FIG. 3 is an exploded perspective view of the pump 50 illustrated in FIG. 1 as seen from the top surface side.

The pump 50 includes a main portion 11 and a projection portion 12. The main portion 11 is a cylindrical portion having a top surface, a bottom surface, and a peripheral surface. The projection portion 12 is an annular portion disposed on an end portion of the main portion 11 near the top surface thereof and projecting from the main portion 11 in an outward direction (circumferential direction) perpendicular to the thickness direction. The pump 50 has a vibration space 13 inside the main portion 11.

As illustrated in FIG. 3, the pump 50 is configured such that a thin top plate 21, a thick top plate 22, a side wall plate 23, a vibration plate 24, and a piezoelectric element 25 are laminated in sequence from the top surface side to the bottom surface side. The thin top plate 21 and thick top plate 22 constitute a "top portion 15." The piezoelectric element 25 corresponds to a "driver."

The thin top plate 21 is disc-shaped, constitutes the top surface of the main portion 11, and also constitutes the projection portion 12. The thin top plate 21 has channel holes 31 positioned in the vicinity of its center as seen in plan view. Here, the number of channel holes 31 is more than one (for example, four in the present embodiment), and they are arranged so as to be locally gathered. The channel holes 31 communicate with an external space near the top surface side of the main portion 11 and also communicate with the vibration space 13 inside the main portion 11. The channel holes 31 in the present embodiment are exhaust holes for allowing gas to be ejected to the external space.

The thick top plate 22 constitutes a part of the main portion 11 and has an annular shape having a smaller circumferential diameter than that of the thin top plate 21. The thick top plate 22 has an opening 32 constituting a part of the vibration space 13. The opening 32 is positioned in the center of the thick top plate 22 as seen in plan view. The opening 32 has an opening diameter larger than that of each of the above-described channel holes 31 in the thin top plate 21 and smaller than that of an opening 33 described below in the side wall plate 23. By arranging the opening 32 having such an opening diameter between the opening 33 in the side wall plate 23 and the channel holes 31 in the thin top plate 21, swirling of fluid in the connection portion between the channel holes 31 and vibration space 13 can be suppressed. That is, this can enable the fluid to move in a laminar flow state and can facilitate the flow of fluid.

The side wall plate 23 constitutes a part of the main portion 11 and has an annular shape having the same circumferential diameter as that of the thick top plate 22 and having the opening 33 with an opening diameter larger than that of the opening 32 in the thick top plate 22. The opening 33 constitutes a part of the vibration space 13 and is positioned in the center of the thick top plate 22 as seen in plan view.

The vibration plate 24 includes a frame portion 41, a vibration member 42, and a linking portion 43. The vibration member 42 is disc-shaped. The frame portion 41 has an annular shape that surrounds the perimeter of the vibration member 42 with a gap interposed therebetween and has the same circumferential diameter and opening diameter as those of the side wall plate 23. The frame portion 41 is joined to the bottom surface of the side wall plate 23. The linking portion 43 has a beam shape radially extending from the vibration member 42 and connecting the vibration member 42 and frame portion 41. Thus, the vibration member 42 is elastically supported by the frame portion 41 with the linking portion 43 interposed therebetween. The vibration plate 24 has channel holes 34 in a region surrounded by the frame portion 41, vibration member 42, and linking portion 43 when the vibration plate 24 is seen in plan view. The channel holes 34 communicate with the external space near the bottom surface side of the main portion 11 and also communicate with the vibration space 13 inside the main portion 11. The channel holes 34 in the present embodiment are intake holes for allowing gas to be sucked from the external space.

The piezoelectric element 25 is disc-shaped and attached to the bottom surface of the vibration member 42. The piezoelectric element 25 includes a disc made of a piezoelectric material, such as a PZT ceramic material, and electrodes (not illustrated) disposed on the upper and lower surfaces of the disc. The vibration plate 24 made of metal may be used as the electrode on the upper surface of the piezoelectric element 25. The piezoelectric element 25 has piezoelectricity in which the area is expanded or contracted in the in-plane direction by the application of an electric field in the thickness direction. The use of this piezoelectric element 25 enables an actuator 14 described below to be thin. The piezoelectric element 25 may be attached to the top surface of the vibration member 42 or may be disposed on each of both of the top and bottom surfaces of the vibration member 42, i.e., a total of two piezoelectric elements 25 may be used.

The multilayer body of the vibration member 42 and piezoelectric element 25 constitutes the "actuator 14."

Figure 4:
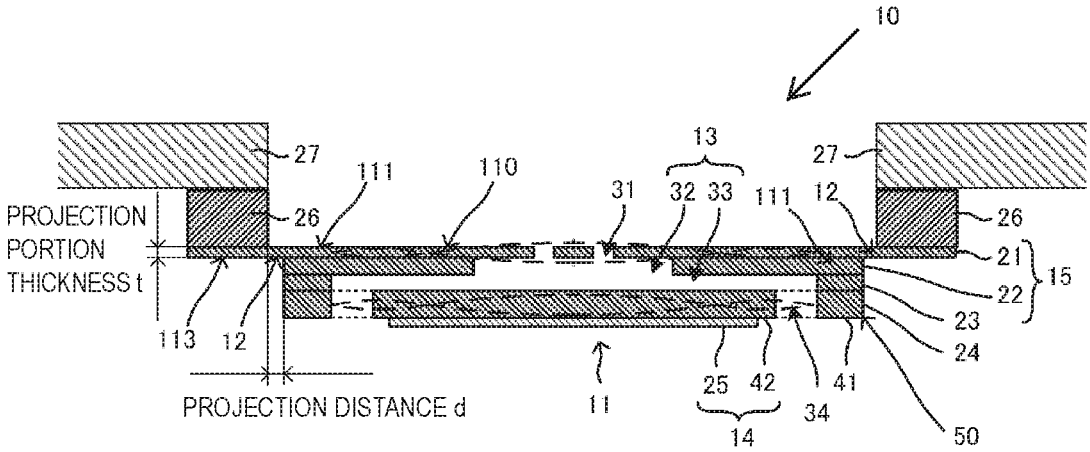
FIG. 4 is a side sectional view of a fluid control device 10 when the pump 50 illustrated in FIG. 1 operates in third-order mode.

FIG. 4 is a side sectional view of the fluid control device 10 when the pump 50 illustrated in FIG. 1 operates in third-order mode. The dotted lines in FIG. 4 indicate the state in which the actuator 14 and top portion 15 vibrate in third-order mode. FIG. 4 also illustrates the state where the pump 50 is mounted on an external structure 27. FIG. 5 is an external perspective view of the external structure 27 illustrated in FIG. 4. The fluid control device 10 includes the pump 50, external structure 27, and a housing (not illustrated).

The pump 50 includes the main portion 11 and projection portion 12. The vibration space 13 is disposed inside the main portion 11. The actuator 14 is arranged on the bottom surface side of the vibration space 13. By mounting a fixation ring (sealing) 26 to the top surface of the thin top plate 21, the pump 50 is fixed to the external structure 27 with the fixation ring 26 interposed therebetween.

The external structure 27 is mounted to the housing (not illustrated) of the fluid control device 10. One example of the external structure 27 may have an annular shape, as illustrated in FIG. 5. One example of the material of the external structure 27 may be stainless steel.

The pump 50 includes the top portion 15 supported by the side wall plate 23 and defining the vibration space 13 with the actuator 14 and side wall plate 23. The top portion 15 includes a top surface portion 110 opposed to the actuator 14 such that a gap is disposed therebetween in the thickness direction, a joint portion 111 extending from the top surface portion 110 in the outward direction and joined to the side wall plate 23, the projection portion 12 extending from the joint portion 111 in the outward direction and projecting beyond the side wall plate 23, and a fixation portion 113 extending from the projection portion 12 in the outward direction and fixed to the external structure 27 with the fixation ring 26 interposed therebetween. The fixation ring 26 is joined to the fixation portion 113 in a position spaced apart from the main portion 11 in the circumferential direction.

The pump 50 may be mounted to the external structure 27 without necessarily the fixation ring 26. For example, the thin top plate 21 may be attached directly to the external structure 27 by pressure-bonding or adhesion. In this case, the fixation portion 113 may be mounted to the external structure 27 by using a screw hole or other similar structure for pressure-bonding created in the fixation portion 113 or adhesive for adhesion applied thereto, or by other similar ways. The pump 50 is driven by the application of an alternating-current drive signal to the piezoelectric element 25. The application of the alternating-current drive signal to the piezoelectric element 25 causes area vibration of the piezoelectric element 25, the area vibration of the piezoelectric element 25 is constrained by the vibration member 42, and thus concentric flexural vibration occurs in the actuator 14 in the thickness direction.

Here, the frequency of the alternating-current drive signal is set at a third-order structure resonant frequency of the actuator 14. The third-order structure resonant frequency is a frequency at which the actuator 14 vibrates in third-order mode. In the actuator 14 vibrating in third-order mode, a first vibration antinode is present in its central portion, and a second vibration antinode whose phase is different from that of the first vibration antinode by 180 degrees is present in its circumferential portion. In this way, when the actuator 14 is vibrated at a resonant frequency of a high order (and odd-number order), vibration by which the actuator 14 is swung vertically does not easily occur. In addition, the vibration amplitude in the circumferential portion of the actuator 14 is reduced, and the vibration of the actuator 14 does not easily leak to the external structure 27 through the frame portion 41 or other similar elements.

The vibration of the actuator 14 is transmitted to the thick top plate 22 and thin top plate 21 through the frame portion 41 and side wall plate 23 or through changes in the fluid pressure in the vibration space 13. Thus, vibration that causes bending in the thickness direction also occurs in the thin top plate 21 in a region opposed to the opening 32 in the thick top plate 22. The vibration occurring in the thin top plate 21 has the same frequency as that of the vibration occurring in the actuator 14 and has a constant phase difference therefrom.

The above-described vibrations are successively generated, and the vibrations cause the gap in the vibration space 13 in the thickness direction to change inward along the circumferential direction of the vibration space 13 in a progressive wave manner. This produces a fluid flow inward in the circumferential direction in the vibration space 13, the fluid is sucked from the channel holes 34, and the fluid is discharged from the channel holes 31.

Here, larger amplitudes of vibrations occurring in the actuator 14 and thin top plate 21 are desired to achieve high pump efficiency in the pump 50. However, some of the vibration occurring in the thin top plate 21 may leak to the external structure 27 through the fixation ring (sealing) 26, and this incurs the risk of impairing the pump efficiency of the pump 50.

The top portion 15 in the pump 50 includes the projection portion 12, which projects beyond the side wall plate 23 in the outward direction. The top portion 15 is fixed to the external structure 27 with the fixation portion 113 outside the projection portion 12. Thus, the leakage of the vibration in the top portion 15 to the external structure 27 is reduced, in comparison with the case where the top portion 15 is fixed to the external structure 27 in a position opposed to the side wall plate 23.

Accordingly, the pump 50 can prevent a reduction in the changes in the gap in the vibration space 13 between the top portion 15 and actuator 14 and can efficiently control the fluid flow in the vibration space 13. The pump 50 can achieve high pump efficiency.

Figure 6:
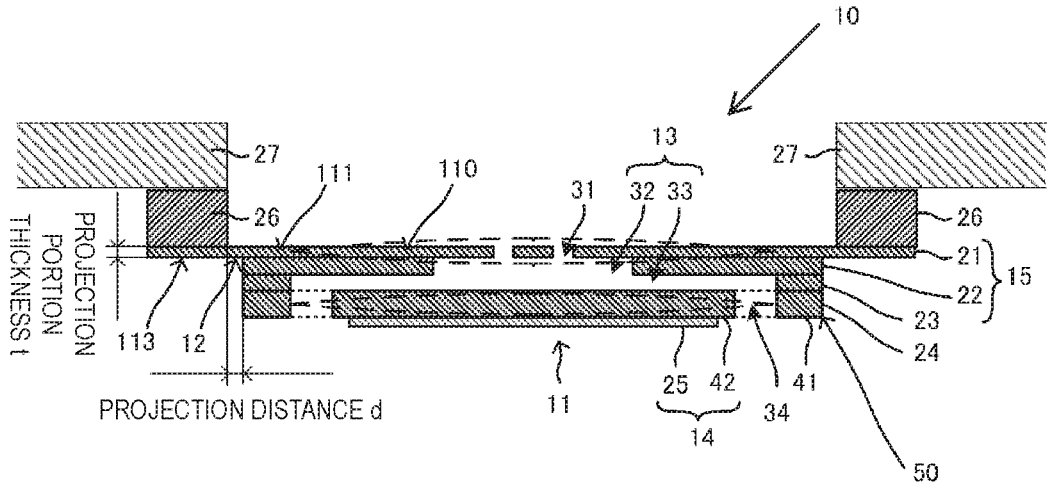
FIG. 6 is a side sectional view of the fluid control device 10 when the pump 50 illustrated in FIG. 1 operates in first-order mode.

The frequency of the alternating-current drive signal in FIG. 4 is set at a three-order structure resonant frequency, but it is not limited to this frequency. The present disclosure is more useful for the case where the actuator 14 vibrates in first-order mode, as illustrated in FIG. 6. This is because when the actuator 14 vibrates in first-order mode, the vibration of the actuator 14 in the central position is large and leakage of the vibration from the top portion 15 to the external structure 27 is also large.

Figure 7:
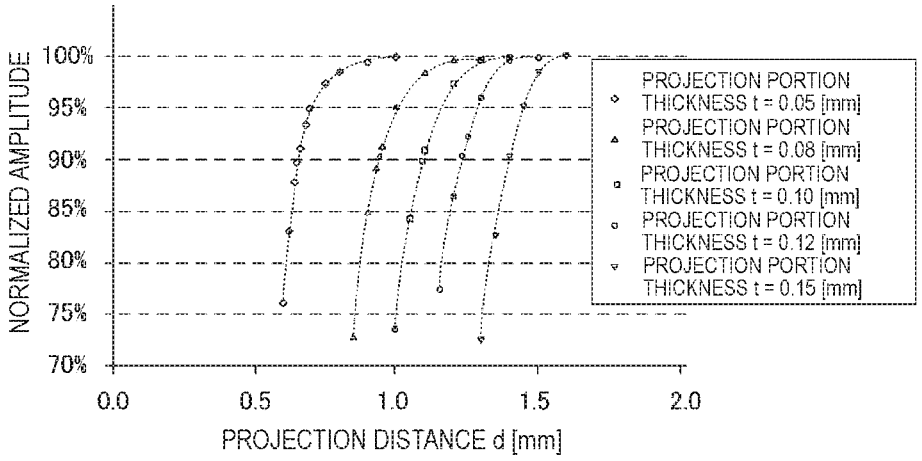
FIG. 7 is a graph for describing a relationship between the length of a projection portion 12 and vibration amplitude.

FIG. 7 is a graph that illustrates a relationship between the length of the projection portion 12 and the changes in the gap at the center (one-sided amplitude) of the vibration space 13. The horizontal axis in the graph indicates the distance from the starting point portion of the projection portion 12 (border portion of the projection portion 12 with the main portion 11) to the endpoint portion of the projection portion 12 (border portion of the projection portion 12 with the fixation ring 26) in the circumferential direction (hereinafter referred to as projection distance d). The vertical axis in the graph indicates the changes in the gap at the center of the vibration space 13 in the state where the pump 50 is mounted to the external structure 27 normalized with the changes in the gap at the center of the vibration space 13 in the state where the pump 50 is not mounted to the external structure 27 (hereinafter referred to as normalized amplitude). FIG. 7 illustrates a relationship between the projection distance d and normalized amplitude for each of a plurality of samples (legend) with different projection portion thicknesses t.

As illustrated, the projection distance d and normalized amplitude have a certain correlation. As the projection distance d reduces, the normalized amplitude reduces. As the projection distance d increases, the normalized amplitude approaches 100%. That is, when the projection distance d is short, some of the vibration in the pump 50 leaks to the external structure 27, and the normalized amplitude is small. When the projection distance d is long, the vibration in the pump 50 does not easily leak to the external structure 27, and the normalized amplitude is large.

Figure 8:
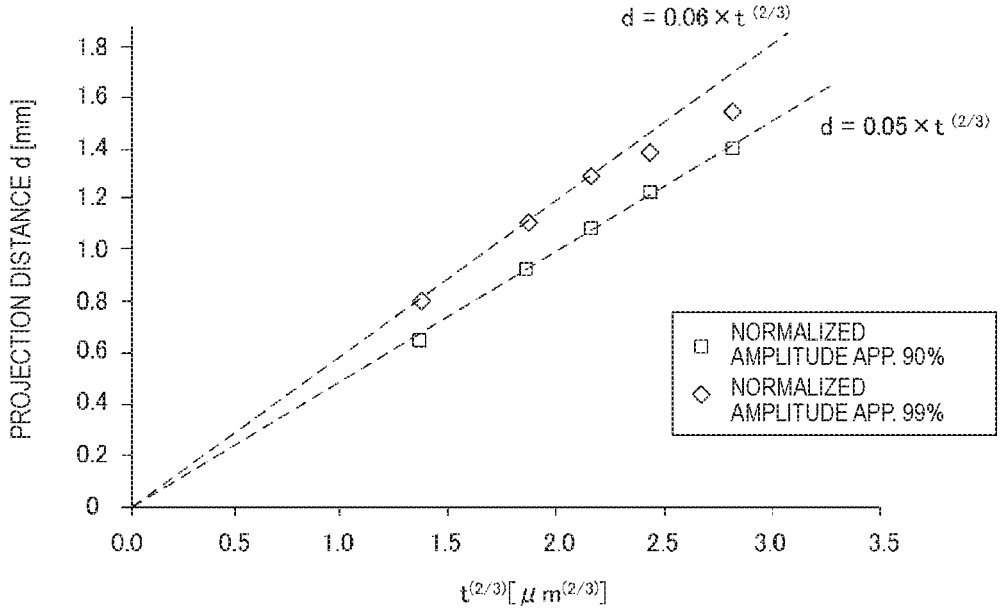
FIG. 8 is a graph for describing a regression line in which the thickness of the projection portion 12 with respect to the length of the projection portion 12 is used as an independent variable.

FIG. 8 is a graph for describing a regression line (regression line that passes through the origin) of the projection distance d calculated based on a plurality of samples from which the same normalized amplitude (90%) is obtainable extracted from the plurality of samples illustrated in FIG. 7 by using the projection portion thickness t as an independent variable.

From the plurality of samples from which an equivalent normalized amplitude (app. 90%) is obtainable for each projection portion thickness t, the regression line L1 described below is obtained.

$$d=0.05\cdot t^{(2/3)} \quad \text{[Math. 4]}$$

The comparison of samples having the same projection portion thickness t in FIG. 7 previously described reveals that the projection distances d of all of samples having normalized amplitudes exceeding 90% are longer than the projection distances d of samples having a normalized amplitude of 90%. Thus all of the samples having normalized amplitudes exceeding 90% falls within a range where the projection distance d is larger, the range being above the regression line L1 in FIG. 8. Accordingly, all of the samples having normalized amplitudes exceeding 90% satisfies the following conditional expression.

$$d\geq 0.05\cdot t^{(2/3)} \quad \text{[Math. 5]}$$

That is, by setting the projection distance d of the projection portion 12 such that it satisfies the above-described conditional expression in accordance with the thickness t of the projection portion 12, the vibration in the pump 50 can be substantially prevented from leaking to the external structure 27. That is, the changes in the gap at the center of the vibration space 13 in the state where the pump 50 is mounted to the external structure 27 can be virtually equal in magnitude to the changes in the gap at the center of the vibration space 13 in the state where the pump 50 is not mounted to the external structure 27. Accordingly, by setting the projection distance d of the projection portion 12 such that it satisfies the above-described conditional expression, the pump efficiency of the pump 50 can be enhanced.

The samples from which an equivalent normalized amplitude (app. 99%) is obtainable for each thickness of the projection portion 12 in FIG. 7 satisfy the conditional expression given by the following expression.

$$0.05 \cdot t^{(2/3)} < d < 0.06 \cdot t^{(2/3)} \quad \text{[Math. 6]}$$

Accordingly, the condition that the normalized amplitude in FIG. 7 previously described is larger than approximately 99% is that the projection distance d satisfies the following expression.

$$d \geq 0.06 \cdot t^{(2/3)} \quad \text{[Math. 7]}$$

Accordingly, by setting the projection distance d of the projection portion 12 such that it satisfies the above-described conditional expression in accordance with the thickness t of the projection portion 12, the vibration in the pump 50 can be almost entirely prevented from leaking to the external structure 27, and the pump efficiency of the pump 50 can be further enhanced.

Even if the projection distance d is excessively increased, it is not expected that the effect of improving the pump efficiency will be correspondingly enhanced. Thus, it is desired that an increase in the projection distance d be restricted to a certain degree in order to, for example, avoid an unneeded increase in the size of the pump 50. For example, the projection distance d of the pump 50 may be set so as to satisfy the following expression.

$$0.06 \cdot t^{(2/3)} \leq d \leq 0.066 \cdot t^{(2/3)} \quad \text{[Math. 8]}$$

That is, the projection distance d of the projection portion 12 may be set at a magnitude on the order of approximately 1.1 times the magnitude at which the pump efficiency of the pump 50 is substantially maximized so as to prevent an increase in the size of the pump 50.

As described above, the pump 50 according to the present embodiment includes the projection portion 12, which projects in the outward direction, which is perpendicular to the thickness direction, and fixes the fixation portion 113 to the external structure 27. Thus, the pump 50 can suppress the leakage of the vibration occurring in the pump 50 to the external structure 27. Accordingly, the pump 50 can achieve high pump efficiency.

Second Embodiment

Next, a fluid control device 10A according to a second embodiment of the present disclosure is described.

Figure 9:
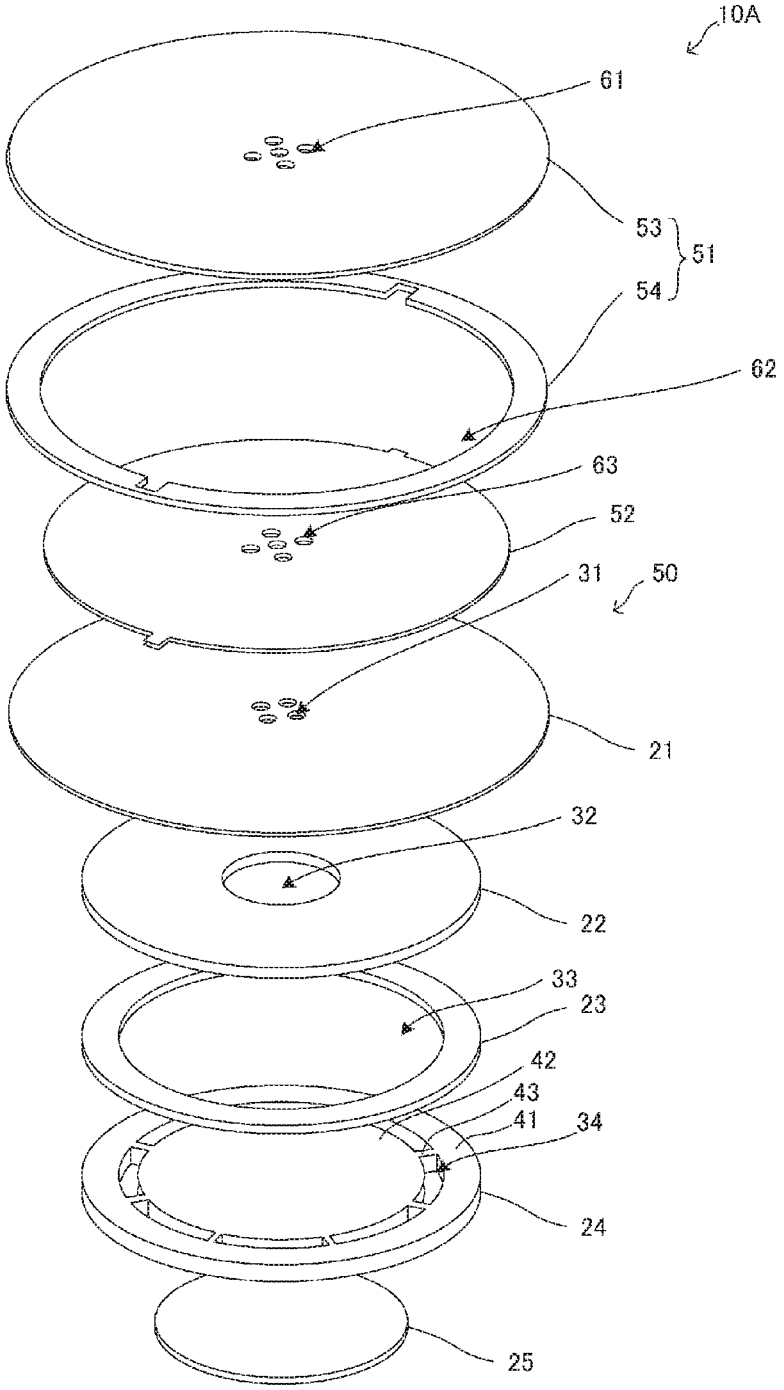
FIG. 9 is an exploded perspective view of a fluid control device 10A according to a second embodiment of the present disclosure.
Figure 10:
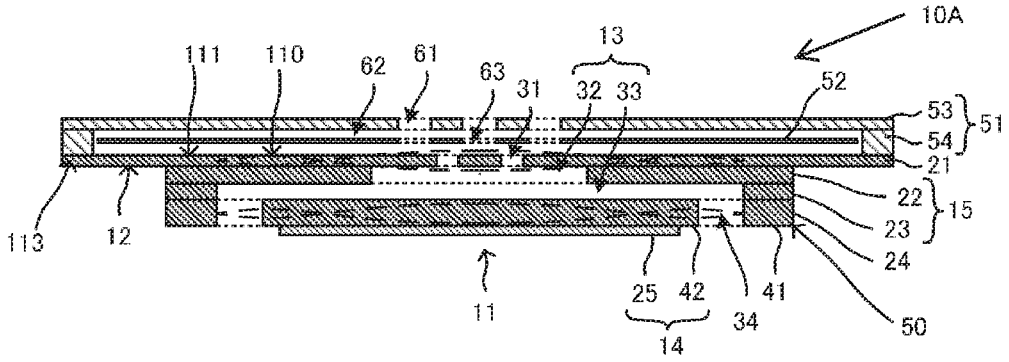
FIG. 10 is a side sectional view of the fluid control device 10A when the pump 50 illustrated in FIG. 9 operates in third-order mode.
Figure 11:
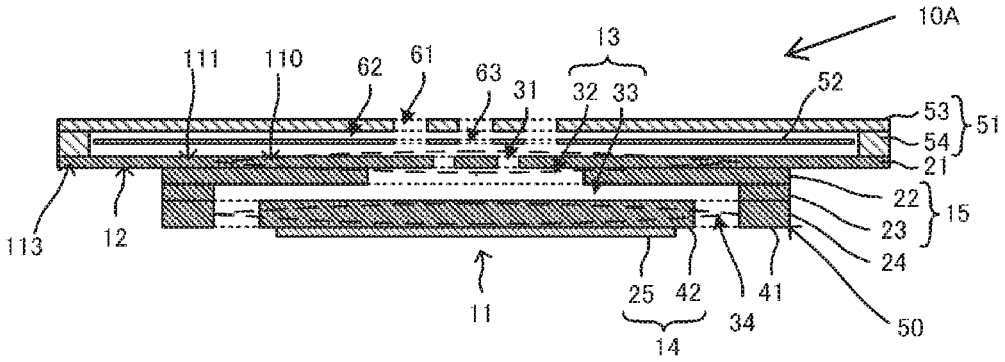
FIG. 11 is a side sectional view of the fluid control device 10A when the pump 50 illustrated in FIG. 9 operates in first-order mode.

FIG. 9 is an exploded perspective view of the fluid control device 10A according to the second embodiment of the present disclosure. FIG. 10 is a side sectional view of the fluid control device 10A when the pump 50 illustrated in FIG. 9 operates in third-order mode. The dotted lines in FIG. 10 indicate the state in which the actuator 14 and top portion 15 vibrate in third-order mode. FIG. 11 is a side sectional view of the fluid control device 10A when the pump 50 illustrated in FIG. 9 operates in first-order mode. The dotted lines in FIG. 11 indicate the state in which the actuator 14 and top portion 15 vibrate in first-order mode.

The fluid control device 10A includes the pump 50 illustrated in the first embodiment and further includes a valve housing 51 and a valve member 52.

The valve housing 51 is laminated on the top surface of the pump 50 and houses the valve member 52. Specifically, the valve housing 51 includes a valve top plate 53 and a valve frame plate 54. The valve top plate 53 is disc-shaped and constitutes the top surface of the valve housing 51. The valve frame plate 54 is laminated between the valve top plate 53 and the top surface of the pump 50 and has an annular shape in which a valve chamber space 62 for housing the valve member 52 is present. The valve member 52 is substantially disc-shaped, is thinner than the valve frame plate 54, and is vertically movable in the valve chamber space 62. One of the circumferential surface of the valve member 52 and the inner wall surface defining the valve chamber space 62 has a depression and the other has a protrusion so that they are engaged with each other, and the valve member 52 is not rotatable in the valve chamber space 62.

The valve top plate 53 has channel holes 61 positioned in the vicinity of the center as seen in plan view. The channel holes 61 communicate with an external space near the top surface side of the valve housing 51 and also communicate with the valve chamber space 62 inside the valve housing 51. The channel holes 61 are arranged in positions displaced from the channel holes 31 in the thin top plate 21 in the pump 50 so as not to be opposed thereto.

The valve member 52 has channel holes 63 positioned in the vicinity of the center as seen in plan view. The channel holes 63 are arranged in positions opposed to the channel holes 61 in the valve top plate 53. That is, the channel holes 63 in the valve member 52 are arranged in positions displaced from the channel holes 31 in the thin top plate 21 in the pump 50 so as not to be opposed thereto, as in the case of the channel holes 61 in the valve top plate 53.

When the fluid control device 10A drives the pump 50, the pump 50 discharges fluid to the valve chamber space 62. With this fluid pressure, the fluid pressure on the bottom surface side of the valve member 52 in the valve chamber space 62 is increased, and the valve member 52 moves toward the valve top plate 53. At this time, because the channel holes 63 in the valve member 52 overlap the channel holes 61 in the valve top plate 53, a path for fluid is opened in the valve housing 51. The fluid is discharged through the channel holes 63 in the valve member 52 and the channel holes 61 in the valve top plate 53 to the external space.

When the fluid pressure in the pump 50 is reduced because, for example, the pump 50 stops being driven and the fluid pressure in the external space on the top surface side of the valve housing 51 is relatively increased, the fluid is about to flow in the opposite direction from the external space through the channel holes 61 in the valve top plate 53 toward the valve chamber space 62. At this time, the fluid being about to flow in the opposite direction from the external space toward the valve chamber space 62 increases the fluid pressure on the top surface side of the valve member 52 in the valve chamber space 62, and the valve member 52 moves toward the pump 50. At this time, the channel holes 63 in the valve member 52 do not overlap the channel holes 31 in the pump 50 and are closed, and backflow of the fluid from the external space to the valve chamber space 62 is prevented.

As described above, the top portion 15 in the pump 50 includes the projection portion 12, which projects beyond the side wall plate 23 in the outward direction. In the fluid control device 10A according to the present embodiment, the above-described valve housing 51 constitutes "external structure" with respect to the pump 50. That is, the fluid control device 10A includes the valve housing 51, in place of the fixation ring 26 and external structure 27 illustrated in the first embodiment. The top portion 15 is fixed to the valve housing 51 with the fixation portion 113 outside the projection portion 12. Thus, the pump 50 can more suppress the leakage of the vibration occurring in the pump 50 to the valve housing 51, in comparison with the case where the pump 50 is fixed to the valve housing 51 in a position opposed to the side wall plate 23.

Accordingly, the pump 50 can prevent a reduction in the changes in the gap in the vibration space 13 between the top portion 15 and actuator 14 and can efficiently control the fluid flow in the vibration space 13. Hence, the pump 50 can achieve high pump efficiency.

Third Embodiment

Next, a fluid control device 10B according to a third embodiment of the present disclosure is described.

Figure 12:
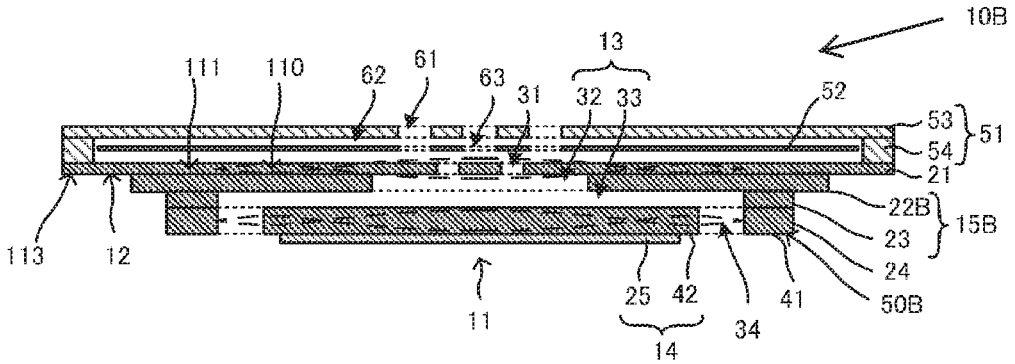
FIG. 12 is a side sectional view of a fluid control device 10B when a pump 50B according to a third embodiment of the present disclosure operates in third-order mode.
Figure 13:
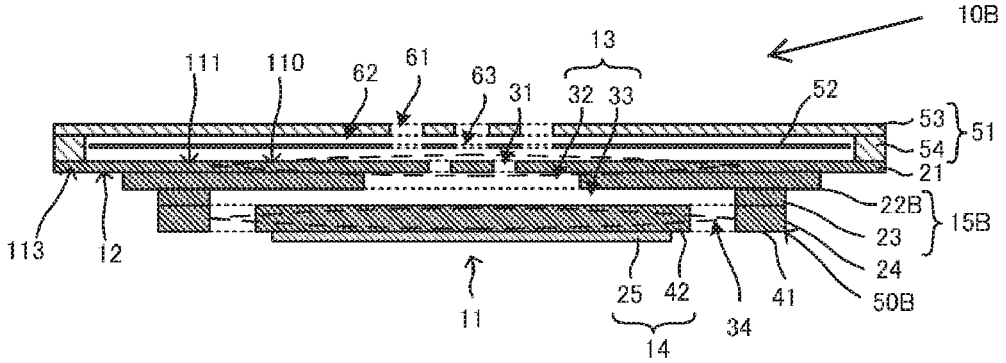
FIG. 13 is a side sectional view of the fluid control device 10B when the pump 50B illustrated in FIG. 12 operates in first-order mode.

FIG. 12 is a side sectional view of the fluid control device 10B when a pump 50B according to the third embodiment of the present disclosure operates in third-order mode. The dotted lines in FIG. 10 indicate the state in which the actuator 14 and top portion 15B vibrate in third-order mode. FIG. 13 is a side sectional view of the fluid control device 10B when the pump 50B illustrated in FIG. 12 operates in first-order mode. The dotted lines in FIG. 13 indicate the state in which the actuator 14 and top portion 15B vibrate in first-order mode.

The fluid control device 10B includes the pump 50B having a configuration different from that in the pump 50 illustrated in the second embodiment. The pump 50B includes a thick top plate 22B. The circumferential diameter of the thick top plate 22B is larger than that of each of the side wall plate 23 and vibration plate 24 and smaller than that of the thin top plate 21.

As described above, the top portion 15 in the pump 50B includes the projection portion 12, which projects beyond the side wall plate 23 in the outward direction. In the fluid control device 10B having this configuration, the valve housing 51 constitutes "external structure" with respect to the pump 50B. That is, the fluid control device 10B includes the valve housing 51, in place of the fixation ring 26 and external structure 27 illustrated in the first embodiment. The top portion 15 is fixed to the valve housing 51 with the fixation portion 113 outside the projection portion 12. Thus, the pump 50B can more suppress the leakage of the vibration occurring in the pump 50B to the valve housing 51, in comparison with the case where the pump 50B is fixed to the valve housing 51 in a position opposed to the side wall plate 23.

Accordingly, the pump 50B can prevent a reduction in the changes in the gap in the vibration space 13 between the top portion 15 and actuator 14 and can efficiently control the fluid flow in the vibration space 13. Hence, the pump 50B can achieve high pump efficiency.

In this configuration, because the circumferential diameter of the thick top plate 22B is larger than that of each of the side wall plate 23 and vibration plate 24, substantial stiffness of the projection portion 12 is increased. Therefore, in comparison with the first embodiment and second embodiment, the vibration leaks more easily from the pump 50B to the valve housing 51 through the projection portion 12. Thus, for the configuration in the present embodiment, the projection distance of the thin top plate 21 from the thick top plate 22B can be further increased or that the thickness of the thin top plate 21 can be further reduced. Even with the configuration in the present embodiment, because the valve housing 51, which is the external structure, is fixed by the fixation portion 113, the leakage of the vibration from the pump 50B can be more suppressed, in comparison with known configurations.

Fourth Embodiment

Next, a fluid control device 400 according to a fourth embodiment of the present disclosure is described.

Figure 14:
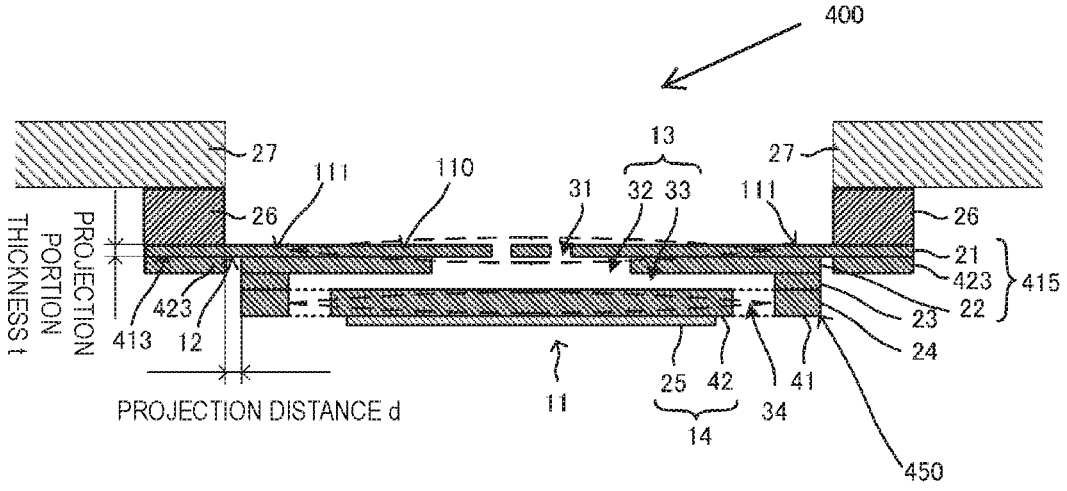
FIG. 14 is a side sectional view of a fluid control device 400 according to a fourth embodiment of the present disclosure.
Figure 15:
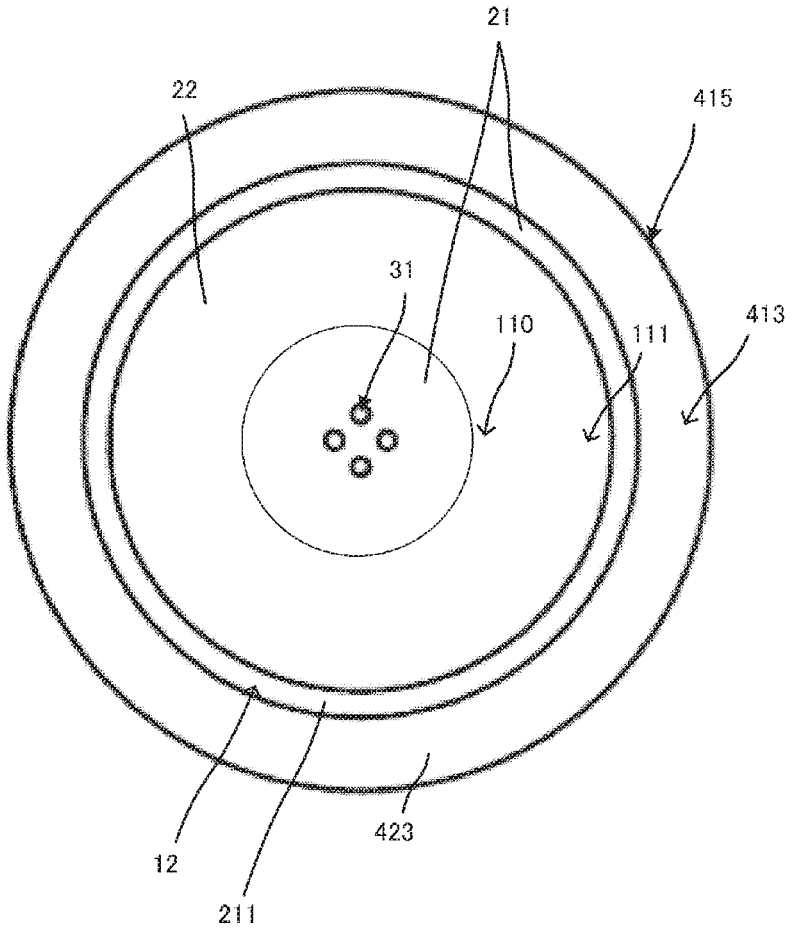
FIG. 15 is a bottom view of a top portion 415 illustrated in FIG. 14.

FIG. 14 is a side sectional view of the fluid control device 400 according to the fourth embodiment of the present disclosure. The dotted lines in FIG. 14 indicate the state in which the actuator 14 and top portion 415 vibrate in first-order mode. FIG. 15 is a bottom view of the top portion 415 illustrated in FIG. 14.

The fluid control device 400 in the fourth embodiment differs from the fluid control device 10 in the first embodiment in that it includes a pump 450. The pump 450 differs from the pump 50 in that the top portion 415 is made up of the thin top plate 21, thick top plate 22, and an annular frame plate 423. The top portion 415 includes the top surface portion 110, joint portion 111, projection portion 12, and a fixation portion 413. The other configuration is the same and is not described here.

The frame plate 423 is joined to the bottom surface in a region in the thin top plate 21 fixed to the external structure 27 with the fixation ring 26 interposed therebetween. Thus, the thickness of the fixation portion 413 is larger than that of the fixation portion 113.

As illustrated in FIG. 15, the projection portion 12 includes a thin portion 211 being thinner than the joint portion 111. The thin portion 211 is annular. The thin portion 211 corresponds to an example of a first thin portion in the present disclosure.

As described above, the top portion 415 in the pump 50 includes the projection portion 12, which projects beyond the side wall plate 23 in the outward direction. The top portion 415 is fixed to the external structure 27 with the fixation portion 413 outside the projection portion 12. Thus, the pump 50 can more suppress the leakage of the vibration occurring in the pump 50 to the external structure 27, in comparison with the case where the pump 50 is fixed to the external structure 27 in a position opposed to the side wall plate 23.

Accordingly, the pump 50 can prevent a reduction in the changes in the gap in the vibration space 13 between the top portion 415 and actuator 14 and can efficiently control the fluid flow in the vibration space 13. Hence, the pump 50 can achieve high pump efficiency.

Because the projection portion 12 includes the thin portion 211, the pump 50 can have a reduced stiffness of the projection portion 12. Hence, the pump 50 can more suppress the leakage of the vibration occurring in the pump 50 to the external structure 27 through the projection portion 12.

The pump 450 in FIG. 14 operates in first-order mode, but it is not limited to that configuration. In practice, the pump 450 may operate in third-order mode.

Fifth Embodiment

Next, a fluid control device 500 according to a fifth embodiment of the present disclosure is described.

Figure 16:
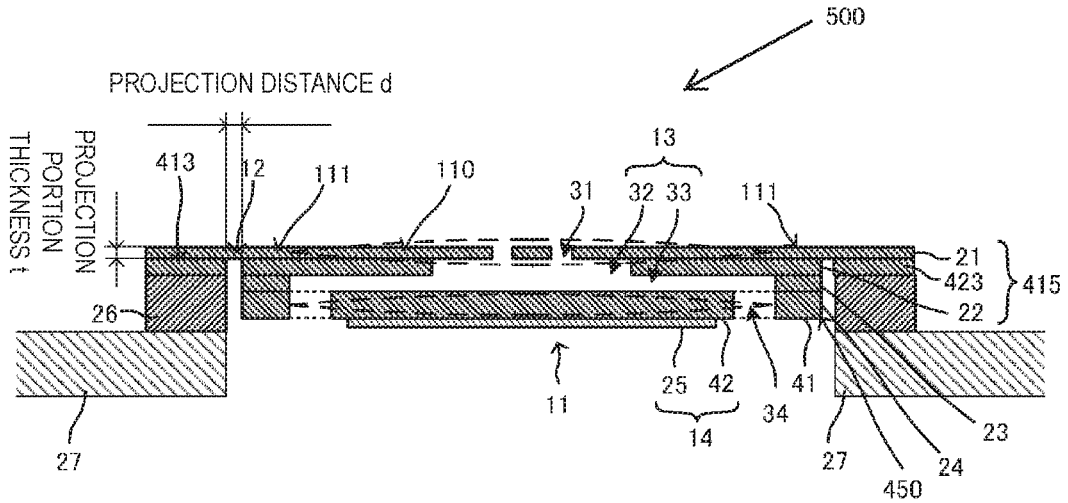
FIG. 16 is a side sectional view of a fluid control device 500 according to a fifth embodiment of the present disclosure.

FIG. 16 is a side sectional view of the fluid control device 500 according to the fifth embodiment of the present disclosure.

The fluid control device 500 in the fifth embodiment differs from the fluid control device 400 in the fourth embodiment in how the pump 450 is fixed. In the fluid control device 500, the bottom surface of the fixation portion 413 in the pump 450 is fixed to the external structure 27 with the fixation ring 26 interposed therebetween. The other configuration is the same and is not described here.

While the pump 450 in the fluid control device 400 and fluid control device 500 operates, the atmospheric pressure and the pressure of the vibration space 13 are applied to both surfaces of the top portion 415. While the pump 450 operates, the pressure of the vibration space 13 is higher than the atmospheric pressure.

Thus in the fluid control device 500 illustrated in FIG. 16, while the pump 450 operates, because of the pressure difference between both surfaces of the top portion 415, a force is exerted on the top portion 415 in a direction away from the external structure 27.

In contrast, in the fluid control device 400 illustrated in FIG. 14, while the pump 450 operates, because of the pressure difference between both surfaces of the top portion 415, the top portion 415 is pressed against the external structure 27. Thus, the force for fixing the fluid control device 400 is stronger than that for fixing the fluid control device 500.

Accordingly, the top surface (i.e., a surface with a lower pressure) of the fixation portion 413 in the pump 450 illustrated in FIG. 14 can be fixed to the external structure 27 with the fixation ring 26 interposed therebetween.

Other Embodiments

Example variations described below can be used as the top portion 415 illustrated in FIG. 15.

Figure 17:
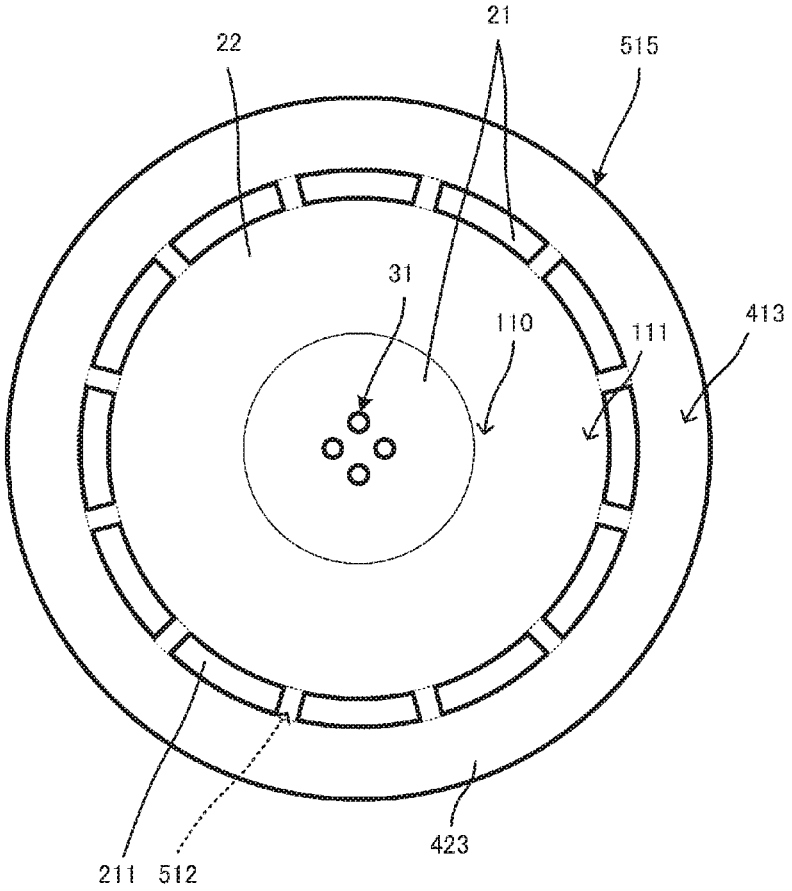
FIG. 17 is a bottom view of a top portion 515 according to a first variation of the top portion 415 illustrated in FIG. 15.
Figure 18:
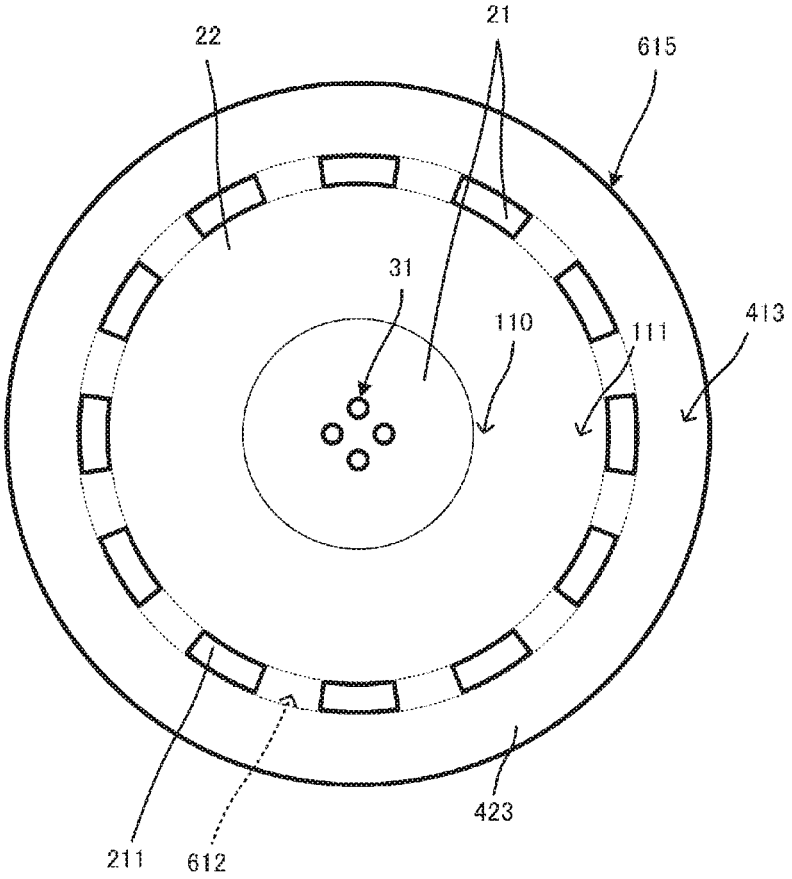
FIG. 18 is a bottom view of a top portion 615 according to a second variation of the top portion 415 illustrated in FIG. 15.
Figure 19:
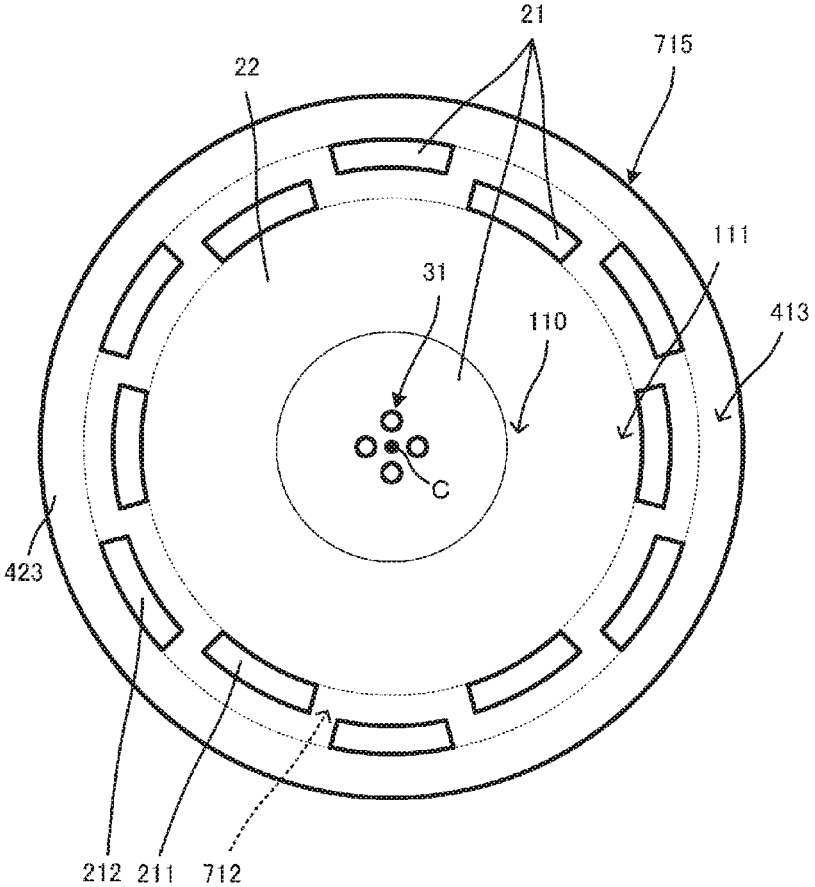
FIG. 19 is a bottom view of a top portion 715 according to a third variation of the top portion 415 illustrated in FIG. 15.

FIG. 17 is a bottom view of a top portion 515 according to a first variation of the top portion 415 illustrated in FIG. 15. FIG. 18 is a bottom view of a top portion 615 according to a second variation of the top portion 415 illustrated in FIG. 15. FIG. 19 is a bottom view of a top portion 715 according to a third variation of the top portion 415 illustrated in FIG. 15.

The top portion 515 illustrated in FIG. 17 and the top portion 615 illustrated in FIG. 18 differ from the top portion 415 in that they have different proportions of the thin portion 211 in the projection portion 12. The other configuration is the same and is not described here.

When the projection portion 12 is annular and the thin portion 211 is arranged in an annular shape, the symmetry of the vibration in the top portion 415 is maintained. Thus, unnecessary vibration does not easily occur in the top portion 415, and an energy loss is lessened.

In addition, as the proportion of the thin portion 211 in the projection portion 12 is higher, the stiffness of the projection portion 12 in the pump 50 can be more reduced. Thus as the proportion of the thin portion 211 in the projection portion 12 is higher, the pump 50 can more suppress the leakage of the vibration occurring in the pump 50 to the external structure 27.

The proportion of the thin portion 211 in the projection portion 12 can be equal to or larger than 50%, as illustrated in FIG. 18. The proportion of the thin portion 211 in the portion 12 can be equal to or larger than 80%, as illustrated in FIG. 17. The proportion of the thin portion 211 in the portion 12 can be equal to 100%, as illustrated in FIG. 15.

As illustrated in FIGS. 15 to 18, the projection portion 12 includes the annular thin portion 211, but it is not limited to this configuration. In practice, the thin portion 211 may have a shape other than the annular shape (e.g., a polygonal ring shape).

Next, the top portion 715 illustrated in FIG. 19 differs from the top portion 415 in that it includes a projection portion 712. The other configuration is the same and is not described here.

The projection portion 712 includes the thin portion 211, which is thinner than the joint portion 111, and a thin portion 212 being thinner than the joint portion 111. The thin portion 211 is annular. The thin portion 212 is also annular. The distance from the central axis C of the top surface portion 110 to the thin portion 211 is different from the distance from that to the thin portion 212. The thin portion 211 corresponds to one example of a first thin portion in the present disclosure. The thin portion 212 corresponds to one example of a second thin portion in the present disclosure.

In the top portions 415, 515, 615, and 715 illustrated in FIGS. 15 to 19, the projection portion 12 can have no opening. In this case, the pump 50 can separate the spaces above and below the top portion 415, 515, 615, and 715 from each other. Thus, the pump 50 can confine the path for fluid to the vibration space 13 and can precisely control the fluid.

Next, example variations described below can be used as the external structure 27 illustrated in FIG. 4.

Figure 20:
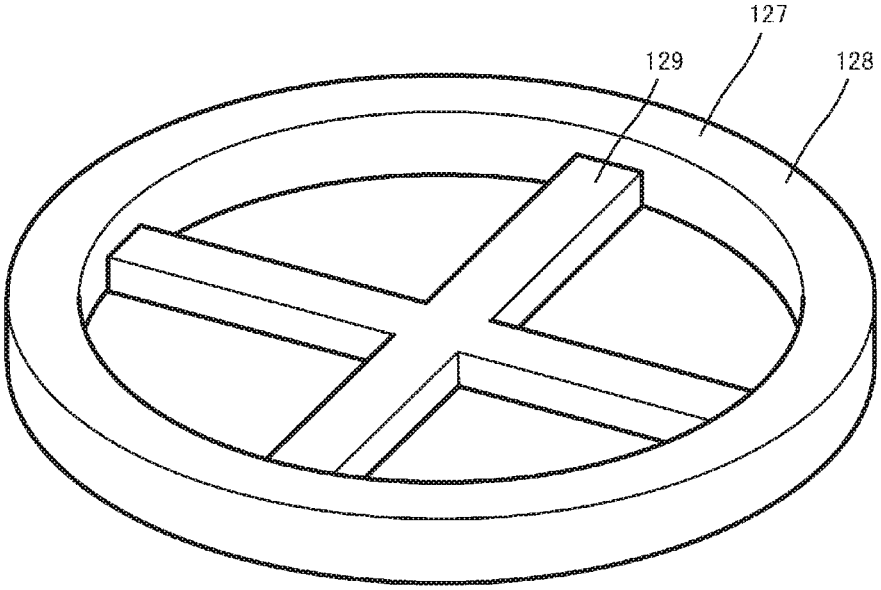
FIG. 20 is an external perspective view of an external structure 127 according to a first variation of the external structure 27 illustrated in FIG. 4.
Figure 21:
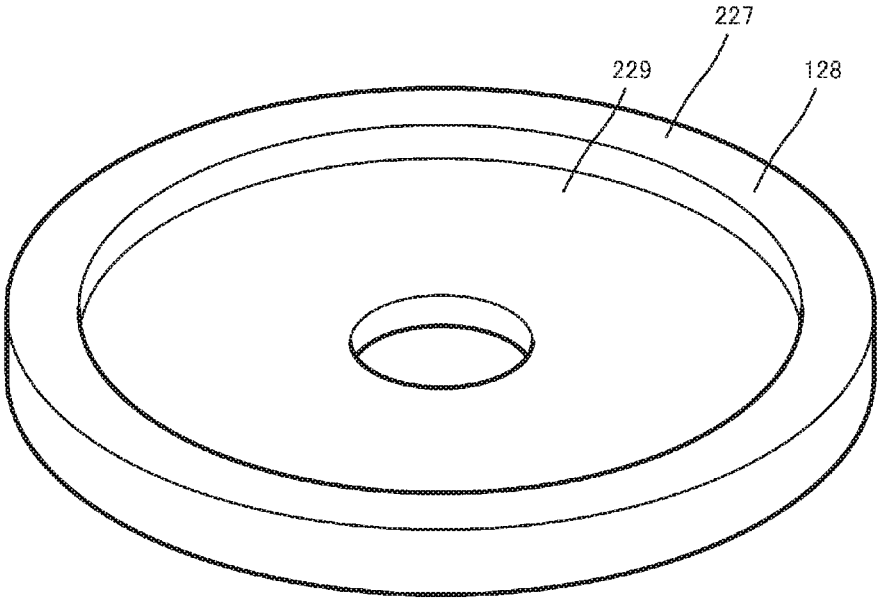
FIG. 21 is an external perspective view of an external structure 227 according to a second variation of the external structure 27 illustrated in FIG. 4.
Figure 22:
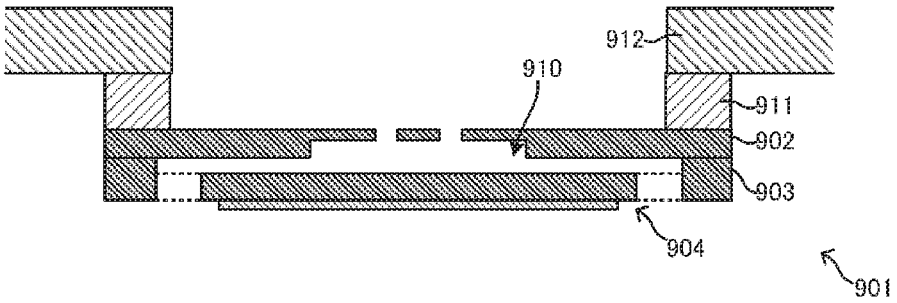
FIG. 22 is a side sectional view of a pump 901 according to a known example.

FIG. 20 is an external perspective view of an external structure 127 according to a first variation of the external structure 27 illustrated in FIG. 4. FIG. 21 is an external perspective view of an external structure 227 according to a second variation of the external structure 27 illustrated in FIG. 4.

The external structure 127 illustrated in FIG. 20 differs from the external structure 27 illustrated in FIG. 4 in that it includes a reinforcement portion 129. The external structure 127 includes a ring-shaped portion 128 to be joined to the fixation portion 113 in the pump 50 and the reinforcement portion 129, which is positioned inside the ring-shaped portion 128. The other configuration is the same and is not described here.

As described above, because the stiffness of the external structure 127 is increased by the reinforcement portion 129, the vibration of the external structure 127 is suppressed. Thus, transmission of the vibration occurring in the pump 50 to a housing (not illustrated) of the fluid control device 10 through the external structure 127 can be significantly reduced.

Similarly, the external structure 227 illustrated in FIG. 21 differs from the external structure 27 illustrated in FIG. 4 in that it includes a reinforcement portion 229. The external structure 227 includes the ring-shaped portion 128 to be joined to the fixation portion 113 in the pump 50 and the reinforcement portion 229, which is positioned inside the ring-shaped portion 128. The other configuration is the same and is not described here.

As described above, because the stiffness of the external structure 227 is increased by the reinforcement portion 229, the vibration of the external structure 227 is suppressed. Thus, transmission of the vibration occurring in the pump 50 to the housing (not illustrated) of the fluid control device 10 through the external structure 227 can be significantly reduced.

Each of the external structure 27 and ring-shaped portion 128 is annular, but it is not limited to this shape. In practice, each of the external structure 27 and ring-shaped portion 128 may have a shape other than the annular shape (e.g., a polygonal ring shape).

In the above-described embodiments, an example in which the piezoelectric element is disposed as the driving source for the pump is illustrated. The present disclosure is not limited to this example. For instance, the pump may be configured to perform pumping by electromagnetic driving.

In the above-described embodiments, an example in which the piezoelectric element 25 is made of a PZT ceramic material is illustrated. The present disclosure is not limited to this example. For instance, the piezoelectric element 25 may be made of another piezoelectric material, such as a non-lead piezoelectric ceramic material, for example, potassium sodium niobate-based or alkali niobate-based ceramic material.

In the above-described embodiments, an example in which the piezoelectric element is joined to a principal surface of the vibration plate opposite the vibration space is illustrated. The present disclosure is not limited to this example. For instance, the piezoelectric element may be joined to a principal surface of the vibration plate near the vibration space. Two piezoelectric elements may be joined to both principal surfaces of the vibration plate.

In the above-described embodiments, an example in which the piezoelectric element, vibration plate, vibration space, and other element are arranged in a circular shape as seen in plan view is illustrated. The present disclosure is not limited to this example. For instance, the shape may be a rectangle or polygon.

In the above-described embodiments, an example in which the actuator is driven at a third-order resonant frequency is illustrated. The present disclosure is not limited to this example. For instance, the actuator may be driven at a first-order resonant frequency or other resonant frequency.

In the above-described embodiments, an example in which the plurality of circular channel holes are gathered in the vicinity of the center of the top portion, valve casing, and valve member is illustrated. The present disclosure is not limited to this example. For instance, one channel hole may be disposed, one or more noncircular channel holes may be disposed, or one or more channel holes extending in the outward direction may be disposed in the side wall plate.

In the above-described embodiments, an example in which the depression portion is disposed in the vibration space in the vicinity of the channel holes on the top portion side is illustrated. The present disclosure is not limited to this example. The depression portion may not be disposed.

In the above-described embodiments, an example in which the top portion is configured as a multilayer body of the thin top plate and thick top plate. The present disclosure is not limited to this example. For instance, the top portion having the above-described shape may be configured as a single-piece member. The top portion may be configured with a uniform thickness as the whole.

Lastly, the description of the above embodiments is illustrative in all respects and is not restrictive. The scope of the present disclosure is indicated by the claims, not the embodiments. The scope of the present disclosure embraces the claims and their equivalents.

REFERENCE SIGNS LIST

C central axis
10, 10A, 10B fluid control device
11 main portion
12 projection portion
13 vibration space
14 actuator
15 top portion
15B top portion
21 thin top plate
22, 22B thick top plate
23 side wall plate
24 vibration plate
25 piezoelectric element
26 fixation ring
27 external structure
31 channel hole
32, 33 opening
34 channel hole
41 frame portion
42 vibration member
43 linking portion
50 pump
50B pump
51 valve housing
52 valve member
53 valve top plate
54 valve frame plate
61 channel hole
62 valve chamber space
63 channel hole
110 top surface portion
111 joint portion
113 fixation portion
127 external structure
128 ring-shaped portion
129 reinforcement portion
211 thin portion
212 thin portion
227 external structure
229 reinforcement portion
400 fluid control device
413 fixation portion
415 top portion
423 frame plate
450 pump
500 fluid control device
515 top portion
615 top portion
712 projection portion
715 top portion
901 pump
902 top portion
903 side wall portion
904 vibration portion
910 vibration space
912 external structure

The invention claimed is:

1. A pump comprising:

a vibration plate comprising a vibration member configured to vibrate in a thickness direction, and at least one channel hole;

a side wall portion that supports an end portion of the vibration plate;

a top portion supported by the side wall portion; and a space delimited by the top portion, the vibration plate, and the side wall portion, wherein the top portion includes:

a top surface portion facing the vibration plate such that a gap is disposed therebetween in the thickness direction, a joint portion extending from the top surface portion in an outward direction perpendicular to the thickness direction and joined to the side wall portion, a projection portion extending from the joint portion in the outward direction and projecting beyond the side wall portion, and a fixation portion extending from the projection portion in the outward direction and fixed to an external structure, wherein the projection portion has no opening.

2. The pump according to claim 1, wherein the projection portion includes a first thin portion that is thinner than the joint portion.

3. The pump according to claim 2, wherein a following conditional expression is satisfied, $$0.05t^{(2/3)} \leq d \leq 0.066t^{(2/3)}$$

where d denotes a dimension of the projection portion in the outward direction, and t denotes a dimension of the projection portion in the thickness direction.

4. A fluid control device comprising:

the pump according to claim 2; and the external structure.

5. The pump according to claim 2, wherein the first thin portion is arranged in a ring shape.

6. The pump according to claim 5, wherein a following conditional expression is satisfied, $$0.05t^{(2/3)} \leq d \leq 0.066t^{(2/3)}$$

where d denotes a dimension of the projection portion in the outward direction, and t denotes a dimension of the projection portion in the thickness direction.

7. A fluid control device comprising:

the pump according to claim 5; and the external structure.

8. The pump according to claim 2, wherein the projection portion includes a second thin portion that is thinner than the joint portion, and a distance from a central axis of the top surface portion to the first thin portion differs from a distance from the central axis of the top surface portion to the second thin portion.

9. The pump according to claim 8, wherein a following conditional expression is satisfied, $$0.05t^{(2/3)} \leq d \leq 0.066t^{(2/3)}$$

where d denotes a dimension of the projection portion in the outward direction, and t denotes a dimension of the projection portion in the thickness direction.

10. A fluid control device comprising:

the pump according to claim 8; and the external structure.

11. The pump according to claim 1, wherein a following conditional expression is satisfied, $$0.05t^{(2/3)} \leq d \leq 0.066t^{(2/3)}$$

where d denotes a dimension of the projection portion in the outward direction, and t denotes a dimension of the projection portion in the thickness direction.

12. The pump according to claim 11, wherein a following conditional expression $0.06\ t^{(2/3)} \leq d \leq 0.066\ t^{(2/3)}$ is satisfied.

13. A fluid control device comprising:

the pump according to claim 1; and the external structure.

14. The fluid control device according to claim 13, wherein the top surface portion has a plurality of channel holes communicating with the space, and the external structure is a valve housing including a valve for opening or closing the plurality of channel holes.

15. The pump according to claim 1, further comprising an inlet and an outlet, wherein:

the inlet and outlet are in fluid communication with each other via the space delimited by the top portion, vibration plate, and side wall portion, and the projection portion of the top portion is outside of the space.

16. The pump according to claim 1, wherein the projection portion is annular.

17. The pump according to claim 1, wherein the gap has a first thickness along a central portion of the top surface portion and a second thickness along a peripheral portion of the top surface portion that is less than the first thickness.

18. The pump according to claim 1, wherein the top potion includes a first plate that defines one or more channel holes and a second plate that defines a second plate opening, the second plate opening having a diameter that is greater than a diameter of each channel hole.

19. The pump according to claim 18, wherein the side wall portion defines a side wall portion opening having a diameter that is greater than the diameter of the second plate opening.

* * * * *